United States Patent [19]

Parker

[11] Patent Number: 4,865,369

[45] Date of Patent: Sep. 12, 1989

[54] REMOVABLE DOOR LOCK

[76] Inventor: L. A. Parker, P.O. Box 476, Broken Arrow, Okla. 74013

[21] Appl. No.: 215,383

[22] Filed: Jul. 5, 1988

[51] Int. Cl.[4] ..... E05C 19/18

[52] U.S. Cl. ..... 292/291

[58] Field of Search ..... 292/289-298, 292/288, 258

[56] References Cited

U.S. PATENT DOCUMENTS

| | | | |
|---|---|---|---|
| Re. 29,162 | 3/1977 | McLennan | 292/290 X |
| 614,052 | 11/1898 | Jackson | 292/295 |
| 743,978 | 11/1903 | Fleischmann | 292/293 |
| 1,154,822 | 9/1915 | Willard | 292/298 |
| 1,302,890 | 5/1919 | Bach et al. | 292/292 |
| 1,308,473 | 7/1919 | Boehringer et al. | 292/295 |
| 2,288,022 | 6/1942 | O'Brien et al. | 292/291 |
| 4,043,578 | 8/1977 | Downs | 292/290 |
| 4,082,335 | 4/1978 | Smith | 292/291 |
| 4,254,976 | 3/1981 | Shoberg | 292/292 |
| 4,763,938 | 8/1988 | Schlanger | 292/290 |

FOREIGN PATENT DOCUMENTS

| | | | |
|---|---|---|---|
| 751628 | 1/1967 | Canada | 292/296 |
| 572125 | 2/1924 | France | 292/291 |
| 575877 | 5/1924 | France | 292/293 |

*Primary Examiner*—Lloyd A. Gall

[57] ABSTRACT

A removable door lock system is disclosed that includes a modified striker plate and a cooperable plate. The striker plate includes an opening in an outwardly extending tongue. The plate has two end portions adapted to bear against the door and the doorjamb. Also, the plate includes an inwardly extending lip insertable into the striker plate tongue opening when the door is in a closed position to prevent the door from opening.

4 Claims, 1 Drawing Sheet

REMOVABLE DOOR LOCK

BACKGROUND OF THE INVENTION

1. Field of the Invention

The present invention relates to a removable door lock and, more particularly, to such a lock that operates on an inside portion of the door and cooperates with a door's striker plate.

2. Setting of the Invention

Various forms of door locks have been developed for use on doors from the inside, i.e. not operable from both inside and outside. Most of these door locks are aftermarket items designed for installation after construction of a home. Long throw dead bolts, crossbars and doorknob clamps/chains have been utilized. All of these above mentioned door locks have disadvantages due to cost, cost and effort of installation, lack of ease of utilization, and possible doorjamb and door damage. A further disadvantage of these door locks is that the lock depends upon the strength of the doorknob or the wood around the door, commonly called the doorjamb. A criminal with a crowbar can easily overpower such a lock. There exists a need for an inexpensive, easy to install and use door lock which doesn't harm the doorjamb and door surfaces and doesn't succumb easily, if at all, to human efforts to force it open.

SUMMARY OF THE INVENTION

The present invention has been designed to overcome the foregoing deficiencies and meet the above described need. Specifically, the present invention is an inexpensive, easy to use, nondamaging and strong door lock. The door lock works as a combination of a modified striker plate securely mounted into the door frame and wall studs, and a plate that mounts to the door and connects with the modified striker plate.

The outwardly extending tongue portion of the striker plate includes an opening, such as an elongated vertical slot. The plate is a substantially rectangular body having a large vertical channel formed therein to define a first end and a second end. An inwardly extending lip adjacent the first end is insertable into the opening in the striker plate when the door is in a closed position to prevent the door from opening.

DETAILED DESCRIPTION OF THE PREFERRED EMBODIMENTS

Figure 1:
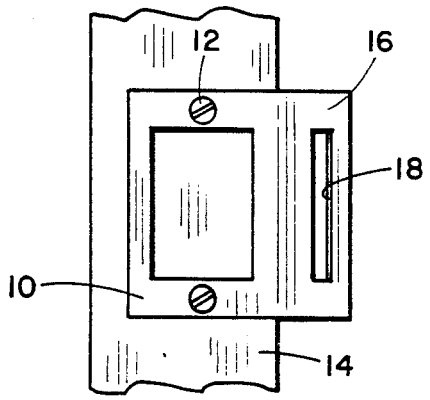
FIG. 1 is a front elevational view of a door striker plate having an opening in a tongue portion thereof in accordance with the present invention.

The removable door lock of the present invention comprises two basic components, a modified striker plate and a locking plate. As shown in FIG. 1, a striker plate 10 of conventional design and material includes screws 12 to securely mount the striker plate into a recess in a surface of a doorjamb 14. Preferably, the screws 12 are of sufficient length to pass through the doorjamb 14 and into wall studs therebehind for added strength and security. A tongue portion 16 of the striker plate 10 includes an opening 18 which can be a slot, circular opening or any desired configuration. For the purposes of this discussion the opening 18 will be described as an elongated, vertical slot.

Figure 2:
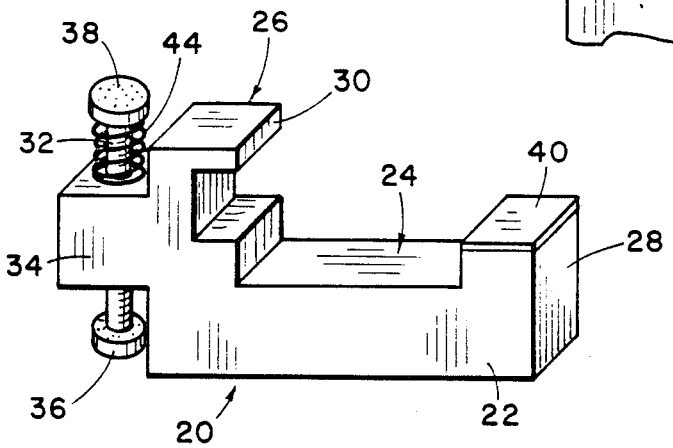
FIG. 2 is a side perspective view of a plate used in cooperation with the modified striker plate in accordance with the present invention.

As shown in FIG. 2, a locking plate 20 comprises a body 22 into which is formed a vertical channel or trough 24 to define a first end portion 26 and a second end portion 28. The purpose of the channel 24 is to permit the first end portion 26 to be disposed against a door and the second end portion 28 to be disposed against the doorjamb or wall while extending across and straddling any sized or configured door trim. Formed as part of the body 22 or connected thereto is an inwardly extending lip 30 adjacent the first end portion 26. The lip 30 is of the size and configuration to be insertable into the opening 18 in the striker plate 10.

Figure 3:
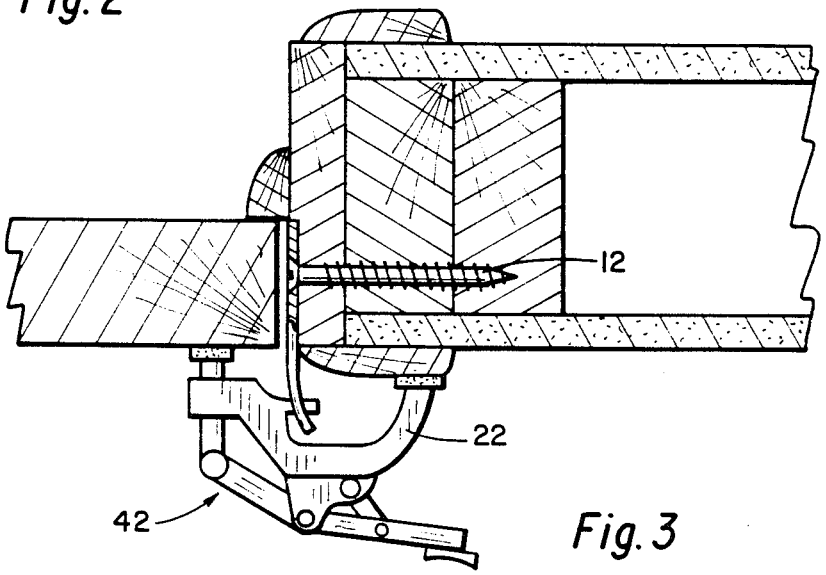
FIG. 3 is a top plan view of an alternate embodiment of the plate cooperably connected to a mounted, modified striker plate.

As shown in FIGS. 2 and 3, the locking plate 20 includes a mechanism for securely mounting the plate 20 to the door. In FIG. 2, this mechanism comprises a threaded screw 32 which extends through an outwardly extending ledge 34 on the body 22, and includes a hand graspable knob 36 on one end and a felt or rubber cushion 38 on the opposite end. A felt or rubber cushion 40 is attached to the second end portion 28 as well. As shown in FIG. 3, the locking mechanism comprises an over center, cam action lever mechanism 42, as is well known to those skilled in the art.

The door lock of the present invention is simple to install. First of all, the modified striker plate 10 must be installed, as is well known in the art. Next, the door is closed and the plate 20 is moved into engagement with the striker plate 10 by inserting the lip 30 into the opening 18 and pressing the second end portion 28 against the doorjamb or wall. The locking mechanism, such as the threaded screw 32 or the over center, cam action lever mechanism 42, is operated so that a pad is pushed against the door to force the plate 20 away from the door but is restrained by the lip 30 within the opening 18. In this manner, the plate 20 is rigidly mounted to the door, but because of the felt or rubber cushions no marring or damage occurs to the door and doorjamb surfaces.

When the door is subjected to opening forces, the door lock securely holds the door in a closed position because of the lip 30 within the opening 18 of the striker plate 10. Tremendous force to open the door would be required because all of the forces are acting perpendicular to the striker plate 10, which is held rigidly in place by the screws 12.

Wherein the present invention has been described in particular relation to the drawings attached hereto, it should be understood that other and further modifications, apart from those shown or suggested herein, may be made within the scope and spirit of the present invention.

What is claimed is:

1. A removable door lock system for preventing a door, abutting a door jamb in a closed position, from opening, comprising:

a plate member having a vertical trough defined between a first end portion and a second end portion, the second end portion adapted to contact the door jamb, the first end portion including an inwardly extending vertically oriented lip of one-piece construction with the plate member, insertable within a opening within a tongue portion of a striker plate, and a length adjustable pressure member horizontally extending from the plate member adjacent the first end portion and outward of the lip, the pressure member adapted to contact the door and bias the plate member away from the door to prevent the door from opening.

2. A removable door lock system of claim 1 wherein the striker plate tongue opening is a vertical slot.

3. A removable door lock system of claim 1 wherein the striker plate is secured to a wall member to which the door jamb is secured.

4. A removable door lock system of claim 1 wherein the pressure member comprises a screw member having a customed pad on a door contacting end and a knob on an opposite end.

* * * * *